United States Patent [19]

Tagawa et al.

[11] 4,253,078

[45] Feb. 24, 1981

[54] ALIGNMENT APPARATUS FOR ELECTRON BEAM TUBE

[75] Inventors: Susumu Tagawa, Fujisawa; Mizuomi Inoue, Ohi, both of Japan

[73] Assignee: Sony Corporation, Tokyo, Japan

[21] Appl. No.: 94,235

[22] Filed: Nov. 14, 1979

[30] Foreign Application Priority Data

Nov. 16, 1978 [JP] Japan ..... 53-141354

[51] Int. Cl.[3] ..... H01F 1/00

[52] U.S. Cl. ..... 335/212; 335/214

[58] Field of Search ..... 335/210, 211, 212, 213, 335/214, 301

[56] References Cited

U.S. PATENT DOCUMENTS

| | | | |
|---|---|---|---|
| 3,743,983 | 7/1973 | Holman | 335/210 |
| 3,974,421 | 8/1976 | Holman | 335/214 X |
| 4,039,986 | 8/1977 | Nakazawa et al. | 335/212 |
| 4,191,936 | 3/1980 | Colgan, Jr. | 335/210 |

*Primary Examiner*—George Harris

*Attorney, Agent, or Firm*—Hill, Van Santen, Steadman, Chiara & Simpson

[57] ABSTRACT

Means for aligning the electron beam of an electron beam in a cathode ray tube so as to adjust the alignment and which includes a rear bobbin portion surrounding the cathode ray tube and which is mounted at least one cylindrical shaped magnet that is magnetized in the direction of a diameter of the cylinder and which can be rotated so as to correct for misalignment in the tube. In one embodiment, two rotatable magnets mounted at right angles relative to each other are utilized and in the second embodiment a single magnet can be utilized and in which the supporting bobbin in which the magnet is mounted can be rotated by 180° is provided.

12 Claims, 9 Drawing Figures

ALIGNMENT APPARATUS FOR ELECTRON BEAM TUBE

BACKGROUND OF THE INVENTION

1. Field of the Invention

This invention relates in general to alignment apparatus for an electron beam in a cathode ray tube for externally adjusting the alignment of the electron beam.

2. Description of the Prior Art

Conventional alignment apparatus for electron beams of cathode ray tubes utilize two rotatable permanent magnet rings which surround the outer portion of the tube where the correction is desired. By adjusting the angular position of these rotatable magnetic rings, the magnitude and direction of the magnetic field for the electron beam in a cathode ray tube can be controlled and the alignment of the electron beam can be made. In the prior art devices, a magnetic shield plate does not generally surround the outside of the portion where the adjustment of the electron beam occurs. Thus, the electron beam is subjected to the influence of an external or environmental magnetic field. So as to avoid the influence of such external magnetic field, a magnetic shield plate may cover the outside of the two magnetic rings. However, in this structure, the means for rotating the magnetic rings relative to each other becomes very complicated.

A second conventional alignment apparatus for electron beam of the prior art comprises an alignment correction coil which surrounds the outside of the electron gun where the beam alignment correction is required. Orthogonal electromagnetic fields generated by the alignment correction coil correct the alignment of the electron beam.

A magnetic shield plate extends over the alignment correction coil to prevent the influence of external and environmental magnetic shields. In this structure, however, there must be applied a constant supply of current for generating the orthogonal electromagnetic field and the structure becomes complicated and expensive and high power is consumed on a continuous basis.

SUMMARY OF THE INVENTION

It is an object of the present invention to provide an alignment apparatus for the electron beam in a cathode ray tube which avoids the difficulties of the prior art. Another object of the invention is to provide an alignment apparatus for an electron beam which is simple in construction.

Another object is to provide an alignment apparatus for an electron beam which is subject to undesirable external and environmental magnetic fields.

A feature of the invention comprises mounting one or two cylindrical magnets in the magnetic deflection region of a cathode ray tube and wherein the magnets can be rotated so as to compensate the electron beam of the cathode ray tube.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
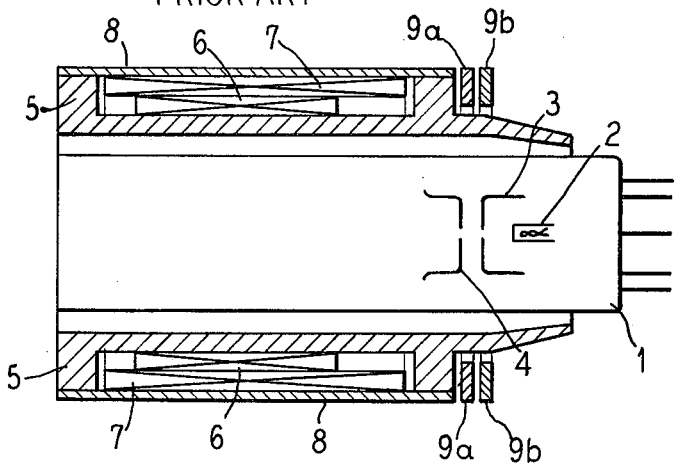
Fig. 1 PRIOR ART
FIG. 1 is a cross-sectional view of a prior art alignment adjustment apparatus for an electron beam tube.

FIG. 1 illustrates a prior art compensating device for the electron beam of a pickup tube 1, which has a cathode 2 which generates an electron beam which passes through grids 3 and 4 for accelerating the electron beam. A bobbin 5 surrounds the pickup tube 1 and a deflection coil 6 and a focusing coil 7 are mounted on the bobbin. A magnetic shield plate of generally cylindrical shape 8 which may be made of permalloy surrounds the deflection focusing coils 6 and 7 as shown. Alignment adjustment apparatus for the electron beam in the pickup tube 1 comprises two permanent magnetic rings **9*a* and 9*b* which are mounted adjacent each other and which are rotatably mounted relative to the pickup tube and relative to each other and surround the outside portion of the pickup tube 1 where the beam alignment correction is required. This corresponds to the portion of the tube between the grid 3 and the grid 4. By rotating the magnetic rings 9*a* and 9*b* the magnitude and direction of the magnetic field for controlling the path of the electron beam in the pickup tube 1** can be controlled and the beam alignment can be adjusted.

In this structure, since the two magnetic rings **9*a* and 9*b* are attached to the bobbin 5 and are mounted to be rotatable relative to the tube, the magnetic shield plate 8 must generally terminate before the rings 9*a* and 9*b* and thus the shield does not cover or surround the portion of the pickup tube where the alignment of the electron beam is accomplished. For this reason, the portion where the electron beam is not shielded by the shield 8 is subjected to the influences of magnetic fields which can comprise external and environmental magnetic fields caused by leakage magnetic flux or terrestrial magnetization. The electron beam in a pickup tube 1 is always subject to the influence of such external magnetic fields. So as to avoid the influence of the external magnetic fields, a magnetic shield plate 8 can be extended to surround or cover the two magnetic rings 9*a* and 9*b*. However, this results in the structure for rotating the magnetic rings 9*a* and 9*b*** relative to each other being very complicated.

Figure 2:
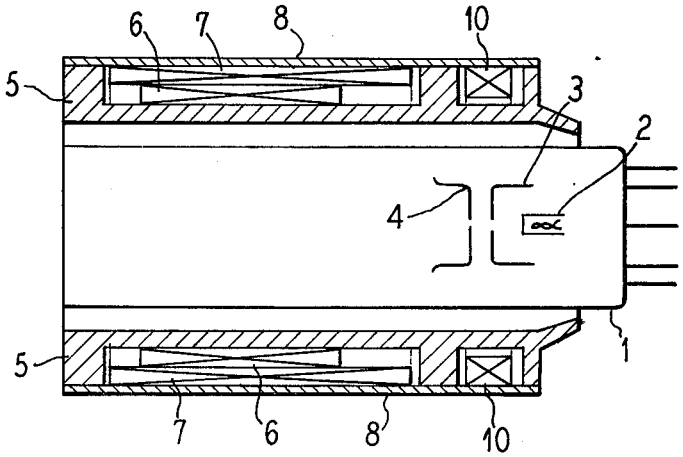
Fig. 2 PRIOR ART
FIG. 2 is a cross-sectional view of another prior art alignment adjustment apparatus for an electron beam tube.

FIG. 2 illustrates another prior art device wherein instead of the magnetic rings 9a and 9b an alignment correction coil 10 which surrounds the outer portion where the beam correction alignment is provided at the portion between the grids 3 and 4. The alignment correction coil 10 must be supplied with a suitable current to generate orthogonal electromagnetic field to adjust the alignment of the electron beam in the pickup tube 1 and in this case the magnetic shield 8 extends so that it covers the alignment correction coil 10 so as to eliminate the influence of external magnetic fields. However, in the prior art device of FIG. 2, constant supply of current for alignment correction must be supplied to the coil 10 to generate the orthogonal electromagnetic field. This makes the structure complicated, expensive and requires the consumption of high power on a continuous basis.

Figure 3:
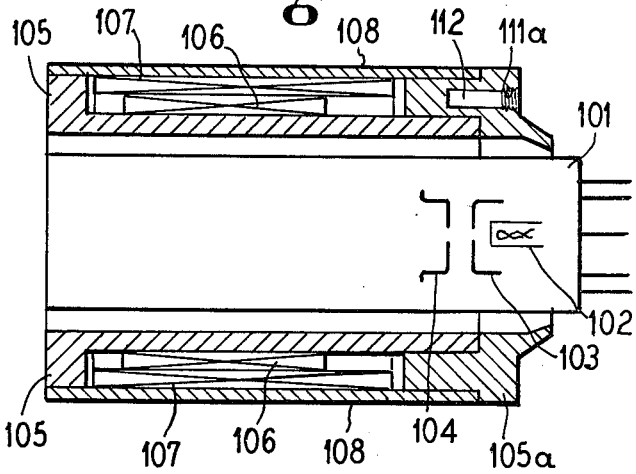
FIG. 3 is a cross-sectional view of an embodiment of an alignment apparatus for an electron beam tube according to the invention.
Figure 4:
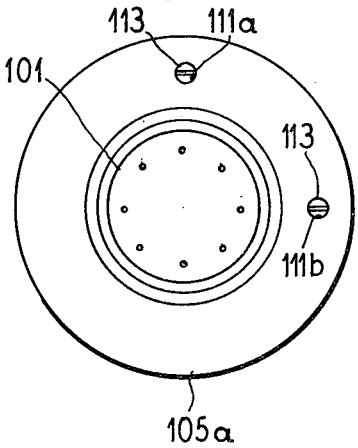
FIG. 4 is a rear plan view of the embodiment illustrated in FIG. 3.

FIGS. 3 and 4 illustrate one embodiment of an alignment adjustment apparatus for electron beam according to the invention.

The cathode 102 produces an electron beam which passes through the grid electrodes 103 and 104 of the pickup tube 101. A main bobbin 105 surrounds the pickup tube 1 and carries deflection and focusing coils 106 and 107 and a cylindrical shield 108 covers the bobbin 105.

Adjacent the portion which surrounds the electrodes 103 and 104, a relatively thick rear bobbin 105a is attached to the main bobbin 105. The rear bobbin 105a surrounds the outside of the pickup tube 101 where the adjustment correction is required, that is the portion between the grids 103 and 104 in the pickup tube 101. The magnetic shield plate 108 made of permalloy extends over the deflection coil 106, the focusing coil 105 and that portion of the rear bobbin 5a which surrounds the adjustment region of the pickup tube 101.

A pair of cylindrical holes 111a and 111b are formed in the rear bobbin 105a and their axis extend parallel to the axis of the pickup tube 101 from the rear end surface of the bobbin 105a to the region where beam alignment correction is required, that is the region which is radially offset from the space between the grids 103 and 104.

Figure 5A:
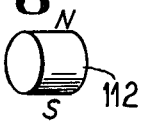
FIG. 5A is a isometric view of the compensating magnet according to the invention.
Figure 5B:
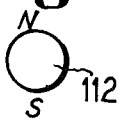
FIG. 5B is an end view of the compensating magnet according to the invention.

As illustrated in FIG. 4, the openings 111a and 111b are formed to lie on axes which are at right angles to each other relative to the center of the pickup tube and assuming that the center of the pickup tube is the origin of the X-Y coordinate system thus formed, the holes 111a and 111b are formed on the X and Y axes, respectively. A pair of cylindrical shape magnets 112 are magnetized diametrically as illustrated in FIGS. 5A and 5B. The magnets 112 may be made of ferrite and are inserted into the holes 111a and 111b so that they may be rotated about their axes.

Figure 6:
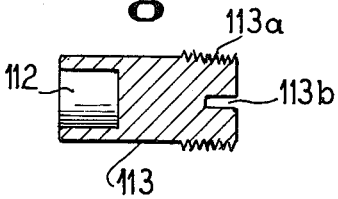
FIG. 6 is a cross-sectional view of the magnetic holder and magnet according to the invention.

FIGS. 5A and 5B illustrate the perspective and rear view of the cylindrical shape magnets 112 according to the invention. Each of the magnets 112 are mounted in cylindrical shaped holders 113 which are formed with a cavity for receiving the magnets 112 as illustrated in FIG. 6 and are formed with a threaded external portion 113a at their outer end and a slot 113b so as to allow the holder 113 to be rotated with a screw driver so as to rotate the magnet 112. The outer ends of the openings 111a and 111b are also threaded so as to mate with the threads 113a of the holders 113 and the holders 113 and the magnets 112 are threadedly received in the openings 111a and 111b.

In use, the beam from the cathode 102 is aligned by inserting a screw driver into the slots 113b to rotate the holder 113 and the magnet 112 until the beam is properly aligned.

Figure 7:
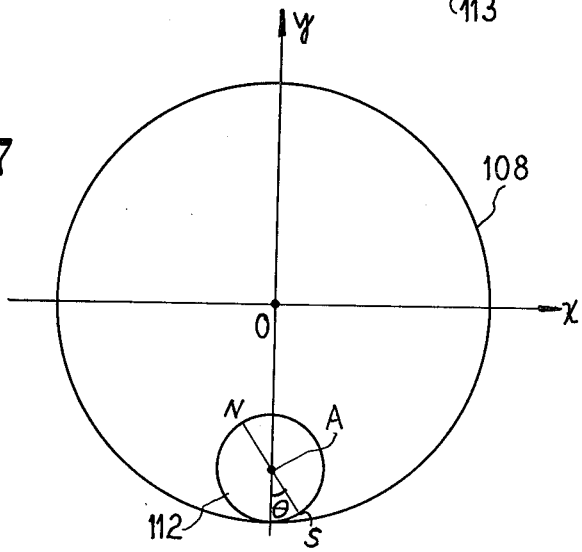
FIG. 7 is a plot of the relationship between the magnet and the magnetic field plate for explaining the invention.

FIG. 7 explains the principle of the alignment adjustment for the electron beam. The cylindrical magnet 112 is mounted within the inside of the tubular magnetic shield plate 108 of permalloy and FIG. 7 illustrates the magnet 112 mounted relative to the origin of the X-Y axis which coincides with the center axial line of the pickup tube 101 and in FIG. 7 the magnet 112 has its center A mounted on the Y axis of the X-Y coordinate system. As the cylindrical shaped magnet 112 is rotated around its axis with a screw driver which is inserted into the slot 113b the direction and magnitude of the magnetic field at the origin can be changed which will compensate for the extraneous magnetic fields effecting the beam of the pickup tube. In a particular embodiment, the radius of the tubular magnetic shield plate 108 was 16 mm, the distance between the origin O and the axis A of the cylindrical magnet 112 was 13.4 mm, the length of the cylindrical magnet 112 was 3 mm and the diameter of the cylindrical magnet 112 was 3 mm. With this structure, the magnitude of the field of the cylindrical magnet 112 was 2 gauss at a point 13 mm perpendicular to the polarized direction of the magnet. As the cylindrical magnet 112 is rotated about its axis, the direction and magnitude of the magnetic field at the origin O will vary as illustrated in FIG. 8 where the field strength in gauss is plotted against the angle $\theta$ which is the angle of rotation of the magnet 112 as illustrated in FIG. 7.

Figure 8:
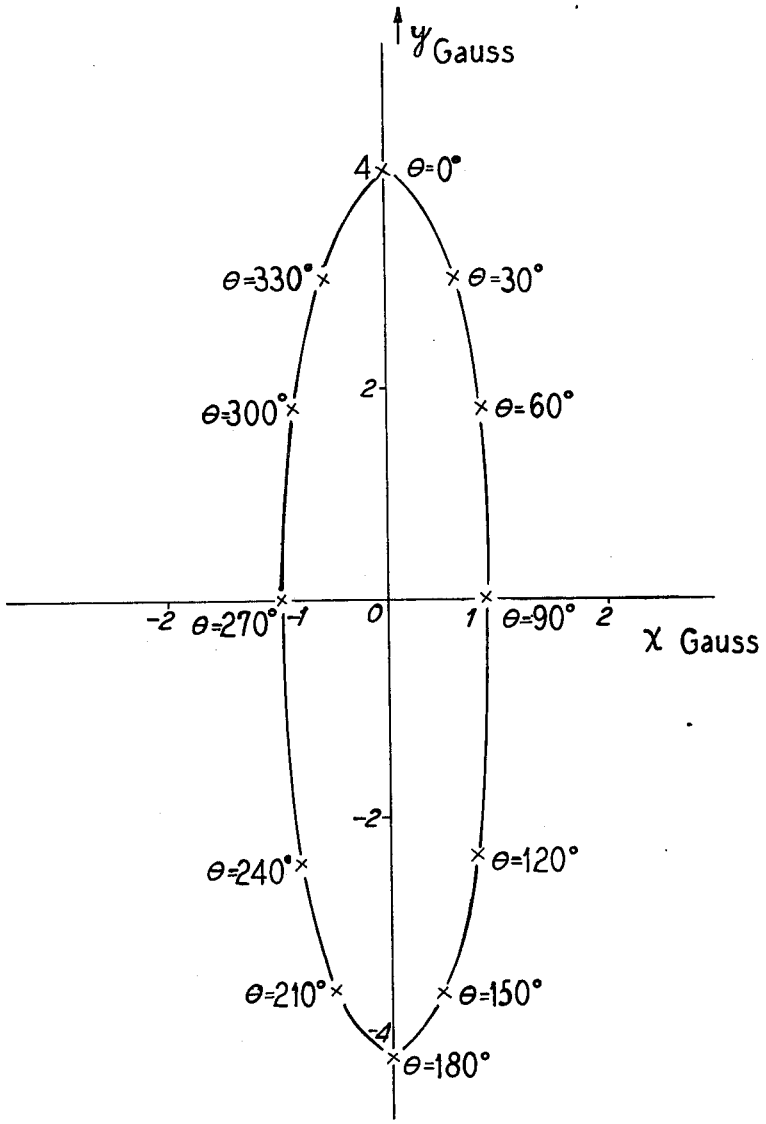
FIG. 8 is a graph illustrating the magnetic field magnitude and direction which varies as a function of the rotation of the magnet.

As shown in FIG. 8, the magnitude of the magnetic field changes substantially on the Y axis as a function of the rotating angle $\theta$ of the magnet 112. Thus, when two separate magnets 112 are respectively placed on the X and Y axis as illustrated in FIG. 4, the direction and magnitude of the magnetic field at the origin O can be changed in an optimum fashion by rotating each of the magnets 112 around its axis. Thus, an adjustment for the electron beam can be made by rotating the cylindrical magnets 112 as illustrated in FIG. 3.

Also, in the present invention, since the magnetic shield plate 108 substantially covers the portion of the tube 101 where the beam alignment correction is required, the electron beam of the pickup tube 101 will not be influenced or disturbed by external magnetic fields.

Thus, according to the invention the mounting of one or more cylindrical magnets between the outside of the pickup tube and the inside of the tubular magnetic shield plate allows alignment adjustments to be made by rotating the magnets around their axes.

Also, since the magnetic shield plate 108 covers the outside of that portion of the tube where the beam alignment correction is required which comprises the space between the grids 103 and 104 of the pickup tube, the electron beam will not be subjected to external magnetic fields.

Instead of installing two cylindrical shaped magnets, the rear bobbin may be provided with only a single cylindrical magnet if the rear bobbin 105a is mounted relative to the main bobbin 105 so that it can be rotated through an angle of 180° around the tubular axis of the pickup tube. When the required alignment direction is known before mounting the rear bobbin 105a, it would be attached to the main bobbin 105 at the desired position which is known beforehand in the case of tubes utilizing magnetic focusing and static deflection which are designated as mixed field type pickup tubes. In such arrangements, a single cylindrical magnet 112 with a holder 113 can be installed so that the cylindrical axis of the magnet 112 is aligned with the central axis of the pickup tube 101.

Although the invention has been described with respect to a pickup tube, it is to be realized that it can be utilized in other cathode ray tubes such as storage tubes. Although the shield plate 108 has been described as being made of permalloy, it can of course be made of other suitable magnetic shielding materials.

Although the invention has been described with respect to preferred embodiments, it is not to be so limited as changes and modifications may be made which are within the full intended of the invention as defined by the appended claims.

We claim as our invention:

1. An alignment apparatus for an electron beam of a cathode ray tube having an electron gun therein comprising, a magnetic band shield surrounding the outside of said tube, and at least one cylindrical-shaped magnet located between said shield and said tube and mounted for rotation on an axis parallel to the axis of said tube, whereby a magnetic field within said tube can be controlled by rotating said magnet around its axis to compensate for undesired magnetic deflection of the electron beam.

2. An alignment apparatus according to claim 1, wherein said cathode ray tube is a pickup tube.

3. An alignment apparatus according to claim 1, wherein said magnetic band shield surrounds the outside portion of said tube which is aligned with said gun.

4. An alignment apparatus according to claim 1, wherein said magnet is magnetized diametrically.

5. An alignment apparatus according to claim 1, wherein a second cylindrical-shaped magnet is mounted between said shield and said tube and is angularly spaced 90 degrees relative to said one magnet.

6. An alignment apparatus according to claim 1, wherein said one magnet is rotatable 360 degrees around its said axis.

7. An alignment apparatus according to claim 5 wherein said second cylindrical magnet is magnetized diametrically and is rotatable 360 degrees around its axis.

8. An alignment apparatus according to claim 1, wherein the position of said cylindrical-shaped magnet can be varied circumferentially relative to said tube such that a single magnet can be used to control said magnetic field.

9. An alignment device according to claim 1 including a rear bobbin which is mounted about said tube and at least a portion thereof within said shield and said one cylindrical-shaped magnet mounted in said rear bobbin.

10. An alignment device according to claim 9 including a cylindrical-shaped holder mounted in said rear bobbin and formed with a slot in one end and said one cylindrical-shaped magnet mounted in said holder.

11. An alignment device according to claim 10 wherein said holder is threadedly received in said rear bobbin.

12. An alignment device according to claim 11 including a second cylindrical-shaped holder mounted in said rear bobbin at 90 degrees to said first holder and formed with a slot in one end, and a second diametrically magnetized magnet mounted in said second holder.

* * * * *